United States Patent [19]

Schukolinski

[11] Patent Number: 4,504,170

[45] Date of Patent: Mar. 12, 1985

[54] BRIDGING EXPANSION JOINT DEVICE

[75] Inventor: Manfred Schukolinski, Velbert, Fed. Rep. of Germany

[73] Assignee: Migua-Mitteldeutsche Gummi-und Asbestgesellschaft Hammerschmidt GmbH, Brugelweg, Fed. Rep. of Germany

[21] Appl. No.: 451,791

[22] Filed: Dec. 21, 1982

[30] Foreign Application Priority Data

Dec. 24, 1981 [DE] Fed. Rep. of Germany ..... 3151516

[51] Int. Cl.[3] ..... E01C 11/12

[52] U.S. Cl. ..... 404/55; 404/67; 404/69; 52/396; 52/573

[58] Field of Search ..... 404/69, 68, 67, 66, 404/64, 55, 54, 53, 49, 47, 52, 61, 65, 6; 14/16.5, 36, 37; 52/573, 470, 471, 396

[56] References Cited

U.S. PATENT DOCUMENTS

| | | | |
|---|---|---|---|
| 1,978,283 | 10/1934 | Rew | 404/47 |
| 3,039,232 | 6/1962 | Dunn | 52/396 |
| 3,527,009 | 9/1970 | Nyquist | 52/396 |
| 3,677,145 | 9/1972 | Wattiez | 404/47 |
| 3,899,261 | 8/1975 | Mieville | 14/16.5 X |
| 4,063,840 | 12/1977 | Fordyce et al. | 52/396 X |
| 4,148,167 | 4/1979 | Puccio | 52/396 |
| 4,184,298 | 1/1980 | Balzer et al. | 52/396 |
| 4,279,533 | 7/1981 | Peterson et al. | 404/68 |

FOREIGN PATENT DOCUMENTS

| | | | |
|---|---|---|---|
| 2264149 | 7/1973 | Fed. Rep. of Germany | 52/396 |
| 3015011 | 10/1981 | Fed. Rep. of Germany . | |
| 1431835 | 4/1976 | United Kingdom | 404/69 |

*Primary Examiner*—Stephen J. Novosad
*Assistant Examiner*—Beverly E. Hjorth
*Attorney, Agent, or Firm*—Arthur B. Colvin

[57] ABSTRACT

The present invention relates to an improved expansion joint for bridging the space between structural components susceptable to relative movement. The joint construction presents an uninterrupted transition between the structural components and is capable of compensating for vertical as well as lateral displacement of the joined parts. The device is capable of withstanding high load forces due to a novel self centering reinforcing rail.

7 Claims, 2 Drawing Figures

BRIDGING EXPANSION JOINT DEVICE

The invention concerns a device for bridging-over an expansion joint. The device includes anchoring angles secured in mirror-fashion at opposite longitudinal edges of the joint. The anchors are each connected moveably with an intermediate section, and include a bearing box extending over its length, wherein is pivotally mounted a marginal strip of a bridging part designed complementary to the bearing box, which engages with its free marginal strip a corresponding marginal strip of the opposite bridging part. The bridging parts are underpinned by a supporting rail.

A device for serving such purpose is known from DE-OS 30 15 011 and serves to bridge-over a joint varying in width between two structural parts. The level is also equalized when the structural parts forming a bottom are displaced relative to each other in vertical direction. While the anchoring angles with the longitudinal joint edges are rigidly connected with the respective structural part at the intermediate sections, the bridging parts held with a marginal strip in the bearing boxes of the intermediate sections can perform a swivel movement about the center axis of the bearing boxes when the structural parts change their level relative to each other. This way a substantially fluid transition can be achieved from the surface of one structural part to the other. The bridging of the joint is maintained in a variation of the joint width, since the free marginal strips of the bridging parts penetrate more or less deeply into each other.

In the known device, one bridging part has a U-shaped cross section, and holds between its two sides the tongue-shaped opposite bridging part. Depending on the profile thickness of the bridging parts, a more or less pronounced step is necessarily formed at the transition from one bridging part to the other.

In order to keep the annoying step as low as possible, the cross sectional thicknesses of the bridging parts are kept lower in the known device than would be required for the loads of the anticipated bending moment. In order to permit the use of the device in highly stressed areas, such as floors of parking garages, supermarkets and other structural surfaces stressed by corresponding wheel loads of vehicles, fork lifters, etc., without deformation of the bridging parts, a supporting rail is rigidly mounted at one of the joint edges supporting at least one bridging part. In order to take into account variations of the joint width, the supporting rail can only be clamped fixedly at one longitudinal edge strip and may extend only over the anticipated minimum joint width. The supporting rail, which thus protrudes freely on the side, must, with increasing joint width, absorb an increased load in the range farthest from the clamping side. The resulting bending movement requires not only a supporting rail with a correspondingly high resistance moment, but also clamping means which withstand the anticipated lever forces.

Another requirement for devices of this type consists in making the joint bridge waterproof. In the above-described known device, an elastic sealing tape is arranged under the bridging parts, and its opposed edges each engage into a groove of the anchoring angles. The water obstacle is thus, below the bridging parts, so that dirty water, for example, is free to pass through the minimum tolerance sliding surfaces of the joints.

The instant invention provides a device for bridging over expansion joints, where steps in the transition range are avoided, and where the bridging parts need be dimensioned only to serve a covering function, the loads to which the joint is subjected being absorbed by supporting rails which are insensitive to sagging.

Starting from the above-described device, the invention suggests for the solution of the noted problems providing a structure which includes a supporting rail having side edges insertable into a groove each of the marginal strips of the bridging parts held in the bearing boxes. The rail is held in the center of the joint between the bridging parts by opposed springs acting between the noted parts.

In the device according to the invention, the supporting rail is not fixedly clamped on one side, but inserted at both sides into grooves of the articulated marginal strips of the bridging parts. The supporting rail can therefore also absorb forces without being formed of unduly thick material.

Of particular importance is also the fact that the longitudinal edge strips of the supporting rail are guided in grooves which are turned in a variation of one structure part to the other by the angle by which the supporting rail must be turned to permit an unchanged tight bearing of the bridging parts without the supporting rail having to be bent before they are exposed at all to any stress from the outside. The optimum central arrangement of the supporting rail is always assured by the springs arranged at both sides of the supporting rail between the latter and the bridging part.

In order to take into account the maximum play of the joint width, it is of particular advantage to use coil springs inserted so far into lateral bores of the supporting rail that the springs are in the completely compressed state when the joint is at its minimum width. The springs are, on the other hand, so dimensioned in length that they are under a light stress against the lateral bottom of the grooves, even in a maximum joint width.

According to one embodiment of the invention, the top side and the underside of the bridging parts are arranged in a common plane, and the plane of the top side represents a common tangent to the curved portions of the two marginal strips of the bridging parts which are rotatably held in the bearing boxes. This design insures, with corresponding dimensioning of the cylindrical marginal strips of the bridging parts and the curved ends of the bearing boxes, that a smooth transition from the surface of one structural part to the other is maintained even with a relatively large displacement of the structural parts in vertical direction.

To avoid any step formation in the transition range from one bridging part to the other, another embodiment of the invention provides that the sides of the interlocking marginal strips of the bridging parts have a meander-shaped course in a plan view, and are so congruent that the teeth of one bridging part can fill tooth gaps of the other bridging part. This embodiment of the invention prevents the formation of a step in the bridging range, independent of the wall thickness of the interlocking bridging parts. Nevertheless it may be of advantage to make the interlocked bridging parts thin-walled, in order to assure that the tooth gap areas, which are unfilled with increasing joint width, as openings of low depth.

The bearing of the supporting rail on both sides insures a great stability of the device, independent of the wall thickness of the interlocking bridging parts.

According to a further feature of the invention, each of the rail supporting elements is composed of two section parts which together form the bearing box. The two parts of each bearing box according to the invention allow insertion of one section part on each anchoring angle. The two bridging parts with the inserted supporting rail can then be inserted perpendicularly to the longitudinal extension of the joint into the bearing box parts of the section parts before the second section parts are connected to the already mounted section parts so that the bridging parts are secured against accidental detachment in the course of mounting.

The section parts are preferably connected to each other by screws, in such manner that the screw heads are countersunk in the top side of the respective section part, and do not project beyond the top side of the bridging parts.

Due to this design according to the invention, the upper section part can be detached easily at any time from the lower section part, so that only the screw joint must be loosened to effect maintenance and repair. After the upper section parts have been removed, the bridging parts together with the supporting rail can be removed, and can be repaired effortlessly and even be replaced. The dis- and re-assembly is thus effected without destroying any section parts or joint edge areas of the structural parts.

In order to make the device according to the invention further waterproof by simple means and to protect particularly the joints of the bridging parts against water over a substantial part of their area, a further feature of the invention provides that, in the region of the bearing box of each intermediate section and/or in the region of the longitudinal edge strips of the bridging rail inserted into the grooves, there be provided grooves which receive sealing strips and which extend in the longitudinal direction of the section.

An excellent water obstacle can be obtained by inserting as sealing tapes rubber or plastic threads in grooves with a corresponding cross section in such a way that a thread edge presses against the respective opposite area.

The device according to the invention has the extreme advantage over known devices of this type that, in case of relative movement of structural parts separated by the joint, the relative displacement in horizontal, as well as in vertical direction is partly compensated by the bridging parts and partly by the supporting rail.

The elements of the device according to the invention where the same is to be used as a heavyload section can be made of aluminum. It is also conceivable to make parts of the device of fiber-reinforced plastics, which attain comparable strength values, if they are reinforced, e.g. with glass or carbon fibers.

An embodiment of the device according to the invention is represented in the drawing.

Figure 1:
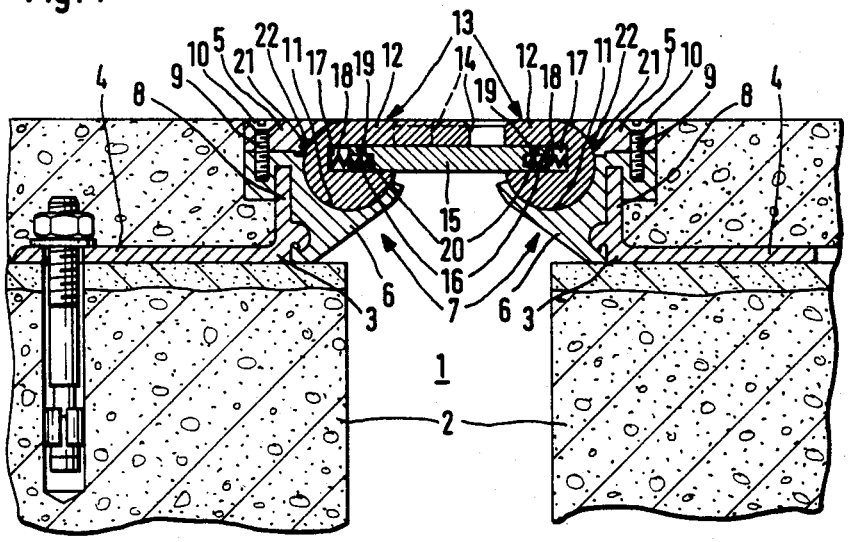
FIG. 1 is a vertical cross sectional view through the device.

In accordance with the invention structural parts 2, which represent the structural floor of a building, are separated from each other by a joint 1.

Along the length of joint 1 at the edges of the structural parts to be connected there are mounted anchoring angles 3, whose horizontal sides 4 are secured to the structural parts by means of bolts or the like.

Intermediate sections 7, composed of two profile parts 5,6 each, are fixedly connected with vertical sides 8 of anchoring angles 3. The connection of section parts 5 and 6 is effected by screws 9, which are countersunk with heads 10 lying in section parts 5.

The intermediate sections 7 each define a bearing box 11, which extends over the length of intermediate sections 7.

Figure 2:
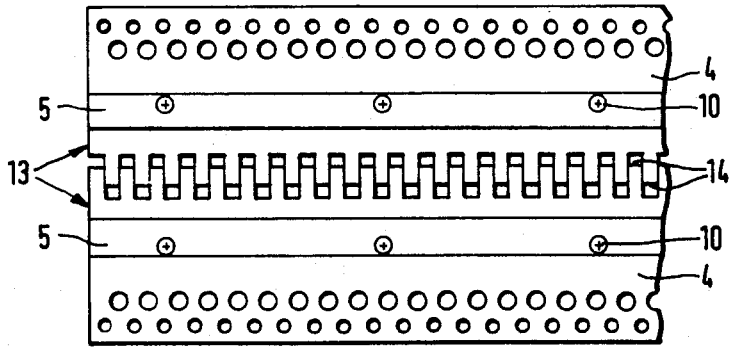
FIG. 2 is a top plan view of a short length, as the device depicted in FIG. 1.

In bearing boxes 11 rest cylindrical marginal strips 12 of bridging parts 13 which are geared with marginal strips 14, as can be seen particularly from FIG. 2.

A supporting rail 15 is mounted to bridging parts 13 by marginal edges 16 of the rail extending into grooves 17 of said bridging parts 13. The rail 15 is held by coil springs 18 in the center of joint 1 notwithstanding any opening or closing of the joint, so that there is never a unilateral displacement of supporting rail 15, and a unilateral load of the device is therefore avoided.

Sealing tapes 19, 21 in corresponding grooves 20 and 22 of section parts 5 and supporting rail 15 respectively form a water obstacle, so that the structural parts as well as the essential parts of the bearing box gliding surfaces are protected from water.

From the foregoing it will be seen that there is described a joint bridging device adopted to span joints between structural components which are likely to move relative to each other. The device can accomodate spreading as well as vertical relative movement of the structural members, is easily installed and repaired and is capable of withstanding even heavy stresses.

As will be apparent to those skilled in the art, numerous variations in construction from the details of the illustrated embodiment may be made without departing from the spirit of the invention. Accordingly the invention is to be broadly construed within the scope of the appended claims.

Having thus described the invention and illustrated its use, what is claimed as new and is desired to be secured by Letters Patent is:

1. A bridging expansion joint device for covering a gap between two structural members comprising a spaced pair of elongate anchor members, each said anchor member being adapted to be secured to a said structural member, said anchor members each including an inwardly facing arcuate groove, said grooves together defining a bearing box, a rigid bridging member mounted in each said groove, said bridging members each including a rigid arcuate outer marginal portion pivotally received in a said groove, the uppermost surfaces of said bridging members being in coplanar alignment, said plane being tangent to the arc of said groove, said bridging members including opposed inwardly facing free marginal edge portions, said bridging members further including opposed inwardly opening slots, said slots together defining a guideway, a longitudinally elongate support rail in said guideway having its opposed marginal edge portions received within said slots of said bridging members, and spring means reacting between said support rail and said bridging members for centering said rail between said bridging members.

2. A device in accordance with claim 1 wherein said marginal edges of said support rail are insertable endwise into said slots of said bridging members.

3. A device in accordance with claim 2 wherein said free marginal edge portions of said bridging members include alternating teeth and gaps, the teeth of each said bridging member lying within the gaps of the other said bridging member.

4. A device in accordance with claim 1 wherein said anchor members are each comprised of two elongate interconnected sections, portions of said inwardly facing arcuate groove being defined by each of said sections.

5. A device in accordance with claim 4 and including threaded fasteners detachably connecting said sections, said fasteners including head portions received within said bridging members.

6. A device in accordance with claim 1 and including elongate seal means interposed between and engaging each said arcuate groove and said arcuate marginal portion of said bridging means retained on said groove.

7. A device in accordance with claim 6 and including second elongate seal means mounted in each of said slots of said bridging means, said second seal means each engaging a portion of said rail.

* * * * *

UNITED STATES PATENT OFFICE

CERTIFICATE OF CORRECTION

PATENT NO. : 4,504,170

DATED : March 12, 1985

INVENTOR(S) : MANFRED SCHUKOLINSKI

It is certified that error appears in the above-identified patent and that said Letters Patent are hereby corrected as shown below:

On the cover page of the patent the lines numbered [73] should be rewritten as follows:

-- [73] Assignee: MIGUA Hammerschmidt GmbH, Heiligenhause, West Germany --.

Signed and Sealed this

*Twenty-seventh* Day of *August 1985*

[SEAL]

*Attest:*

DONALD J. QUIGG

*Attesting Officer* *Acting Commissioner of Patents and Trademarks*